United States Patent [19]

Schoenfelder

[11] Patent Number: 4,483,115

[45] Date of Patent: Nov. 20, 1984

[54] INSULATED BUILDING COMPONENT

[76] Inventor: James L. Schoenfelder, 1926 Farrel Dr., Coralville, Iowa 52241

[21] Appl. No.: 367,446

[22] Filed: Apr. 12, 1982

[51] Int. Cl.[3] ..... E04C 1/40

[52] U.S. Cl. ..... 52/309.12; 52/405; 52/570

[58] Field of Search ..... 52/309.12, 405, 594, 52/570, 571, 607, 612, 568

[56] References Cited

U.S. PATENT DOCUMENTS

| | | | |
|---|---|---|---|
| 0,785,296 | 3/1905 | Dunn | 52/607 |
| 1,381,823 | 6/1921 | Griffin | 52/594 |
| 2,370,638 | 3/1945 | Crowe | 52/570 X |
| 3,817,013 | 6/1974 | Selby | 52/612 |
| 3,965,942 | 6/1976 | Hatch | 52/405 |
| 3,984,957 | 10/1976 | Piazza | 52/405 |
| 4,185,434 | 1/1980 | Jones | 52/405 |

FOREIGN PATENT DOCUMENTS

| | | | |
|---|---|---|---|
| 0200493 | 11/1958 | Austria | 52/594 |
| 0502416 | 4/1951 | Belgium | 52/570 |
| 0888001 | 8/1953 | Fed. Rep. of Germany | 52/570 |
| 0876957 | 11/1942 | France | 52/570 |
| 1128106 | 1/1957 | France | 52/568 |

*Primary Examiner*—J. Karl Bell

*Attorney, Agent, or Firm*—Zarley, McKee, Thomte, Voorhees & Sease

[57] ABSTRACT

An insulated building component which includes two concrete halves having an insulating layer interposed between them. The insulating layer is made from a material with good compression strength and disallows any direct contact between the top half and the bottom half. The top, bottom, end and side surfaces of the building component are parallel or perpendicular with respect to each other and present similar surfaces to those of a standard building block. A plurality of mated walls extend between top and bottom surfaces of the component and are angled to prevent vertical movement of the half members. The facing surfaces of the half members and the outermost edges of the walls are sloped, oppositely with respect to each other, to prevent width-wise lateral movement of the halves. The insulation layer, while retaining its strength in compression between the two halves, serves to decrease the thermal conductivity of the building component.

7 Claims, 8 Drawing Figures

INSULATED BUILDING COMPONENT

BACKGROUND OF THE INVENTION

1. Field of Invention

This invention relates to building components, more particularly, to thermally insulated concrete blocks.

2. Description of Prior Art

Concrete blocks are used extensively in the building industry. They are economical, durable, and readily available. Additionally, concrete has the advantageous property of being strongest in compression. These and other attributes make concrete blocks an attractive choice for builders.

However, concrete blocks have comparatively poor insulating properties. While the insulating properties of a concrete block may be improved by manufacturing the block in a lighter weight form, the block loses its structural capability for heavy load requirements, such as use in exterior wall construction.

Attempts have been made to increase insulating properties by filling in the cores of standard concrete blocks with insulation, but the results have been minimal. A typical 120 pound to 140 pound per cubic foot structural block of eight inch standard width has a R value of 0.9. Filling the cores with insulation produces R values of 2 or 3. An R value of up to 5 may be obtainable if a lighter weight block is manufactured whereby the block tends to insulate itself, but again, its use in heavy load situations is therefore limited, reducing its utility.

The major problem is that concrete of the thickness utilized in concrete blocks is a good thermal conductor, therefore it consistently transfers cold exterior temperatures from its exterior facing side to its interior facing side, forcing the interior heating means to work harder to maintain desired interior temperature, thereby requiring the consumption of more energy.

Any attempt to place a layer of insulation between standard blocks or to essentially cut the block in two and then place an insulating layer between, would not adequately solve the problem. Extreme problems would result from shifting of the blocks or the halves with respect to one another, thereby undermining the structural stability of the block singly and in combination with other blocks. No acceptable method for completely insulating two halves of a concrete block has seen developed.

It is therefore an object of this invention to provide an insulating concrete block which produces a high R value.

Another object of this invention is to provide an insulating building component which contains an insulating layer between two halves of concrete, and does not allow any concrete-on-concrete contact between the two halves.

Another object of this invention is to provide an insulated building component made of two halves wherein any movement pushes the two halves together rather than pulls them apart thus preventing separation of the halves.

Another object of this invention is to provide an insulated building component which can be made of heavy concrete.

A further object of this invention is to provide an insulated building component which is aesthetically attractive so that it may be used for exterior and interior purposes.

Another object of this invention is to provide an insulated building component which is strong, durable and economical, and yet easy of manufacture.

Additional objects, features, and advantages of the invention will become apparent with reference to the specification and the accompanying drawings.

SUMMARY OF THE INVENTION

This invention utilizes two concrete halves having an insulating layer placed between them so that the R value of the resulting block is significantly higher than that of a unitary standard concrete block. The core of the block is constructed in such a manner that the two halves are retained as to one another to disallow separation of the halves. This construction still maintains either the one or two core openings as in standard concrete blocks.

The top and bottom halves present parallel and flat exterior surfaces in accordance with standard concrete blocks. Flat, angularly extending walls extend between these exterior flat surfaces in a configuration which interlocks the two halves into retaining positon with the insulating layer disposed in between.

This interlocking system of walls prohibits vertical or horizontal displacement of the halves in both the lengthwise and widthwise directions. Different embodiments achieve this result by angling the walls, sloping the interior surfaces of the top and bottom halves, and sloping of the outer edges of the walls to oppositely correspond with the sloped interior surfaces.

The top and bottom halves may be made from any concrete substance but in particular, may be made from standard concrete used in standard concrete blocks in the range of 120 pounds to 140 pounds per cubic foot, or may be made of heavier concrete. The insulating layer may be made of a rigid urethane styrofoam which retains good insulating properties even under compression.

DETAILED DESCRIPTION OF THE PREFERRED EMBODIMENTS

Figure 1:
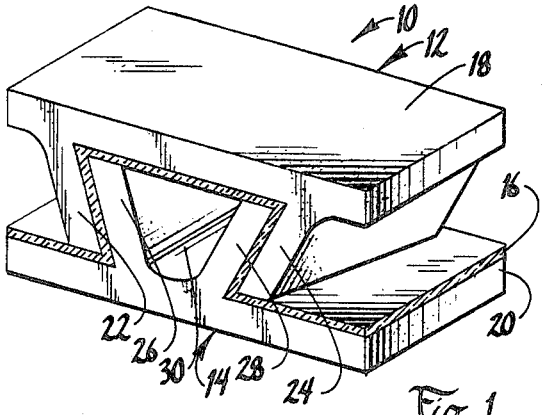
FIG. 1 is a perspective view of the invention.

In reference to the drawings, and particularly FIG. 1, there is shown a building component 10 having a top member 12 and a bottom member 14 interlocked with one another but having an insulating layer 16 interposed between, completely separating any physical contact between the two members 12 and 14. Walls 22 and 24 extend convergingly from top plate member 18 of top half member 12 downwardly towards bottom half member 14. Correspondingly, walls 26 and 28 extend divergingly upward from bottom plate member 20 of bottom half member 14 to present a V-shaped configuration which fits inside of walls 22 and 24 of top half member 12. This structure forms V-shaped core opening 30 and prohibits vertical displacement of top member 12 from bottom member 14.

Figure 2:
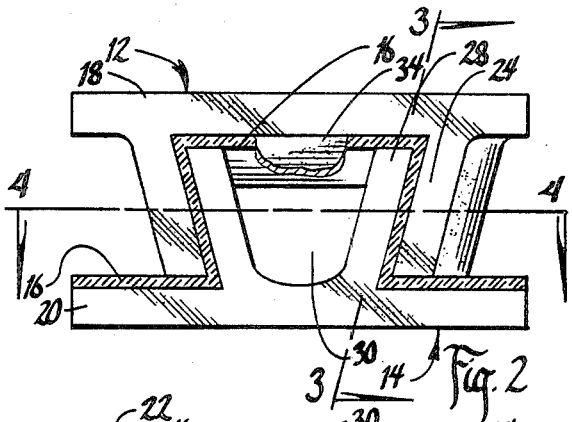
FIG. 2 is a front plan view of the first embodiment.
Figure 4:
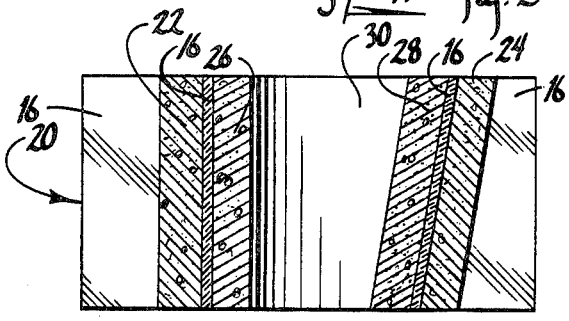
FIG. 4 is a sectional view taken along lines 4—4 of FIG. 2.

Additionally, lateral displacement of half members 12 and 14 is prevented by wedge-shaped section 34 of top plate member 18 and the angling of walls 28 and 24, which is shown in greater detail in FIGS. 2 and 4. Top plate member 18 has a sloped surface wedge-shaped section 34 existing between walls 22 and 24. The uppermost edges of walls 28 and 26 of bottom half member 14 are correspondingly sloped oppositely wedge 34 so that when building component 10 is assembled, the exterior surfaces of top plate 18 and bottom plate 20 are flat and parallel to one another. Walls 28 and 24 are disposed parallel to one another, as are walls 22 and 26. However, walls 28 and 24, in combination, are not parallel to the combination of walls 22 and 26, but rather are angled away, as shown in FIG. 4. This angling prevents lateral movement of top half member 12 with respect to bottom half member 14 in the direction of the outward angling. Correspondingly, the wedge-shaped section 34 and sloped edges of walls 26 and 28 prevent lateral movement in the opposite direction. Notice that on FIG. 2, the insulation has been cut away to show the surface of wedge-shaped section 34.

Figure 3:
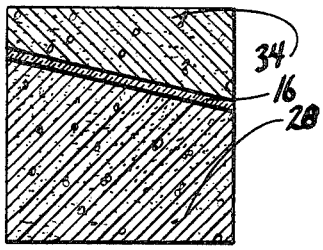
FIG. 3 is a sectional view taken along lines 3—3 of FIG. 2.

FIGS. 3 and 4 show the construction of wedge-shaped section 34, the sloped edge of wall 28 (which is identical to wall 26), and angled walls 28 and 24 in greater detail.

Figure 5:
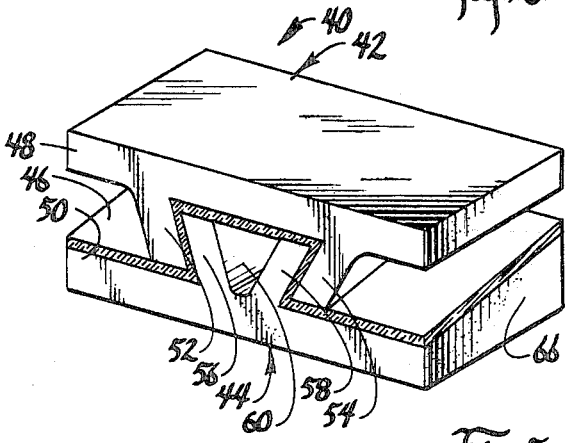
FIG. 5 is a perspective view of the second embodiment.
Figure 6:
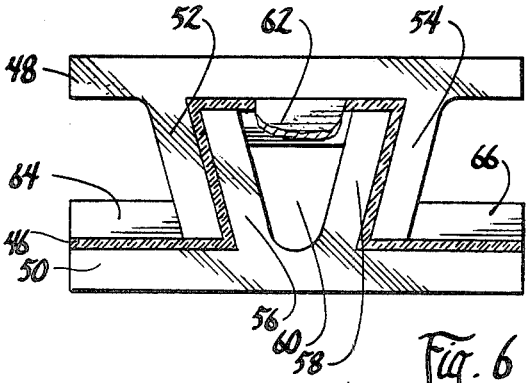
FIG. 6 is a front plan view of FIG. 5.

Building component 40, a modification of building component 10, is shown in FIGS. 5 and 6. As with building component 10, there is a top half member 42 and a bottom half member 44 having an insulating layer 46 interposed between them. Top half member 42 has a top plate member 48 from which extend converging walls 52 and 54 downward. Bottom half member 44 has a bottom plate member 50 which has divergingly upward extending walls 56 and 58 which form the V-shaped core opening 60. Wedge-shaped section 62 exists between walls 52 and 54 on top plate member 48 and functions like wedge-shaped member 34 of building component 10, matingly corresponding with sloped ends of walls 56 and 58. The modification exists in having wedge-shaped sections 64 and 66 of bottom plate member 50 which slope in an opposite direction of wedge-shaped section 62. The downwardmost edges of walls 52 and 54 are correspondingly sloped oppositely to sections 64 and 66. Therefore, lateral movement in either forward or backward directions is prevented. Wedge-shaped sections 64 and 66 take the place of the angling of walls 28 and 24 of building component 10. Insulation 46 is cut away in FIG. 6 to show wedge-shaped section 62.

Figure 7:
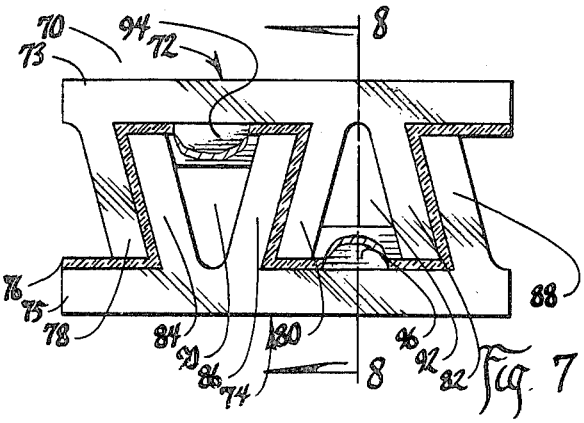
FIG. 7 is a front plan view of the third embodiment.
Figure 8:
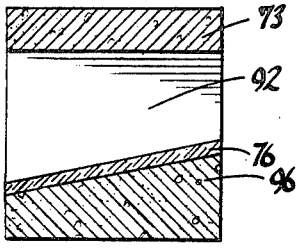
FIG. 8 is a sectional view taken along lines 8—8 of FIG. 7.

Another modification is disclosed in FIGS. 7 and 8. With particular reference to FIG. 7, building component 70 having top half member 72 and bottom half member 74 with insulating layer 76 interposed between, is shown. Top plate member 73 of top half member 72 has three downwardly extending walls 78, 80 and 82. Walls 80 and 82 attach adjacent to one another to top plate 73 and extend divergingly downward forming a V-shaped core opening 92. Wall 78 extends downward and convergingly with wall 80. Reciprocally, bottom plate member 75 has walls 84, 86, and 88 which extend upwardly in such a manner as to interlockingly adjoin walls 78, 80 and 82 of top half member 72. Bottom half walls 84 and 86 extend divergingly upward, from V-shaped core opening 90, and are positioned inside of walls 78 and 80. Wall 88 extends convergingly towards wall 86 of bottom plate member 75, both of which secure walls 80 and 82. Top plate member 73 has wedged-shaped section 94 between walls 78 and 80, while bottom plate member 75 has wedge-shaped section 96 between walls 86 and 88. The top edges of walls 84 and 86 are sloped oppositely wedge-shaped section 94 as are the ends of walls 80 and 82 with respect to wedge-shaped section 96. This configuration presents a building component having two core openings, while still preventing lateral movement of the top half member 72 with respect to bottom half member 74. FIG. 7 has cut aways of insulation layer 76 to show the surface of wedge-shaped sections 90 and 92.

All three embodiments 10, 40 and 70 disclose a building component which has two separate and non-attached halves which have an insulating layer interposed completely between the halves and yet, are interlocked so that movement between the two halves is prevented. Furthermore, any force which attempts to displace the halves with respect to one another, only serves to cause the halves to move a tighter interlocking configuration with one another.

The top and bottom members of the embodiments may be made of concrete while the insulating layer may be made of rigid urethane styrofoam.

The above described descriptions are to the preferred embodiments of the invention, however, it is to be understood that changes can be made in the preferred embodiments herein.

What is claimed is:

1. An insulated building component comprising:

a top member having at least two downwardly and inwardly oriented spaced apart walls and a wedge-shaped portion between said downwardly and inwardly oriented walls, said wedge-shaped portion being of increasing thickness along the sides of said walls;

a bottom member having at least two upwardly and outwardly oriented walls with uppermost edges which are sloped to conform with said wedge-shaped portion of said top member; and an insulating layer interposed between and completely separating said top and bottom members;

the walls of said top member and said bottom member being matingly adjoined and angularly interlocked with each other in a retentive configuration so that relative movement between said top and bottom members apart from one another either vertically or horizontally away from the downward slope of said wedge-shape portion of said top member is prevented, and the mating adjoinment of said wedge-shaped portion of said top member and said sloped uppermost edges of said vertically and outwardly oriented walls of said bottom member prevents relative movement between said top and bottom member laterally in the directon of said downward slope of said wedge-shape portion of said top member, so that relative movement in any direction between said top and bottom members is prevented and any force of forces that would cause movement between said top and bottom members instead causes increasing retentive force between all adjacent surfaces of said top and bottom members.

2. The device of claim 1 wherein said insulated building component further comprises:

said top member having a top plate member with a plurality of walls each having an outermost edge extending downwardly and inwardly towards said bottom members;

said bottom member having a plurality of walls each having an outermost edge extending upwardly and outwardly towards said top member;

said insulating means interposed between said top member and said bottom member; and each of said walls of said top member and bottom member being oriented so that said top half member and said bottom half member are in retentive interlocking position and are incapable of either lateral or vertical separation while also being spaced apart by said insulating layer means.

3. The device of claim 2 wherein said insulating building component further comprises:

said top half member having said top plate member with two downward extending and converging walls attached to the bottom surface of said top plate member, said walls extending the width of said top plate member, said walls converging in a direction towards one another and forming approximately equal interior angles with respect to said bottom surface of said top plate member but having lines of intersection with said bottom surface angularly disposed with respect to one another, said walls being tilted with respect to each other both vertically and horizontally, said bottom surface of said top plate member between said walls being angularly sloped across its width to present an area of increasing thickness, the areas outside of said walls being of substantially uniform thickness;

said bottom half member having a rectangular elongated bottom plate member of substantially uniform thickness with two upwardly extending and diverging walls, said walls extending laterally across the width of said bottom plate member and diverging and positioned as to the top surface of said bottom plate member so that they are complimentary with said walls of said top plate member; and an insulating layer means interposed between said top half member and said bottom half member which disallows any contact between said top half member and said bottom half member.

4. The device of claim 2 wherein said insulated building component further comprises:

a top half member having said top plate member to which is attached on its bottom surface two walls which extend laterally across the width of said bottom surface of said top plate member and extend convergingly downward at approximately equal interior angles with respect to said bottom surface of said top plate member, said top plate member having a substantially flat top surface, said bottom surface being sloped across its width between said walls to present a wedge-like area, the areas of said bottom surface of said top plate member outside of said walls being of substantially uniform thickness;

a bottom half member having said bottom plate member having a substantially flat bottom surface and two walls extending divergingly in a V-shape configuration from the top surface of said bottom half member, so that said walls fit inside said walls of said top half member in a complimentary interlocking fashion, said top surface of said bottom plate member being sloped across its width in the areas outside of said walls of said bottom plate members to present wedge-like areas;

an insulating layer means interposed between said top half member and said bottom half member, said top half member being completely separated from said bottom half member; and the outermost edges of said walls of said top half member and said bottom half member being sloped across their width opposite to said sloped surfaces of said top plate member and said bottom plate member, respectively so that said top surface of said top half member and said bottom surface of said bottom half member are parallel, thereby presenting flat parallel sides for use in building structures.

5. The device of claim 2 wherein said insulated building component further comprises:

said top half member having a rectangular top plate member having a flat top surface and first, second and third angularly downwardly extending walls attached to its bottom surface, said first wall being attached inside a first end of said bottom surface of said top plate member and extending downward and inward and having an outermost edge which is parallel with said first end of said top plate member, said third wall being attached inside the second end of said bottom surface of said top plate member, and extending downwardly and outwardly, said second wall being attached in between said first and third walls to the bottom surface of said top plate member, and being adjacent to said third wall and extending downwardly away from said third wall so that said second wall and said third wall form an inverted V-shape, said first, second and third walls extending laterally across the width of said bottom surface of said top plate member, said bottom surface of said top plate member being sloped downward in between said first and second walls across the width of said top plate member so as to present a wedge-like area;

said bottom half member having a rectangular bottom plate member having a flat bottom surface and first, second and third walls extending upward from the top surface of said bottom half member, said first wall extending upwardly and inwardly from a first end of said bottom plate member which is opposite to said first end of said top plate member and directly below said second end of said top plate member, said third wall member of said bottom plate member extending upwardly and outwardly from near the second end of said top surface of said bottom plate member, said second wall extending upwardly and away from said third wall from said top surface of said bottom plate member between said first and third walls, but being adjacent to said third wall so that said second wall and said third wall combine to form a V-shape, said first, second and third walls extending laterally across the width of said top surface of said bottom plate member, said top surface of said bottom plate member being sloped upwardly in between said first and second walls, presenting a wedge-like area, said wedge-like area of said top surface of said bottom plate member being sloped in an opposite direction to said wedge-like area of said bottom surface of said top plate member;

said second and third walls of said top plate member having outermost edges sloped upward across the length of said edges to correspond with the upward slope of said wedge area of said bottom plate member having outer edges sloped downward along the length of said edges to correspond oppositely with the downward slope of said wedge-like area of said bottom surface of said top plate member, said top surface of said top plate member and said bottom surface of said top plate member being parallel; and an insulating layer means interposed between said top half member and said bottom half member completely separating said top half member from said bottom half member.

6. The device of claim 2 wherein said top half member and said bottom half member are made of concrete.

7. The device of claim 2 wherein said insulating layer means is constructed of rigid urethane styrofoam.

* * * * *